US007891182B2

(12) United States Patent
Kelly et al.

(10) Patent No.: US 7,891,182 B2
(45) Date of Patent: Feb. 22, 2011

(54) WORK MACHINE, CONTROL SYSTEM AND METHOD FOR CONTROLLING AN ENGINE IN A WORK MACHINE

(75) Inventors: Andrew W. Kelly, Sherrill, IA (US); Andrew J. Hageman, Dyersville, IA (US)

(73) Assignee: Deere & Company, Moline, IL (US)

( * ) Notice: Subject to any disclaimer, the term of this patent is extended or adjusted under 35 U.S.C. 154(b) by 408 days.

(21) Appl. No.: 12/042,656

(22) Filed: Mar. 5, 2008

(65) Prior Publication Data

US 2009/0223215 A1 Sep. 10, 2009

(51) Int. Cl.
*F15B 11/00* (2006.01)
*E02F 9/22* (2006.01)

(52) U.S. Cl. ..... 60/431; 60/426; 701/50

(58) Field of Classification Search ..... 60/431, 60/426; 701/50

See application file for complete search history.

(56) References Cited

U.S. PATENT DOCUMENTS

| | | | | |
|---|---|---|---|---|
| 7,370,475 | B2 * | 5/2008 | Nakamura et al. | 60/449 |
| 7,512,471 | B2 * | 3/2009 | Nakamura et al. | 60/443 |
| 2006/0161324 | A1 * | 7/2006 | Ozawa et al. | 701/50 |

* cited by examiner

*Primary Examiner*—Thomas E Lazo
(74) *Attorney, Agent, or Firm*—Taylor IP

(57) ABSTRACT

A method for controlling an engine in a work machine includes determining a base engine operating limit; determining a hydraulic system load on the engine; calculating a modification value for the base engine operating limit; generating a modified engine operating limit based on the modification value and the base engine operating limit; generating an engine control signal based on the modified engine operating limit; and transmitting the engine control signal to operate the engine at the modified engine operating limit to thereby supply additional power from the engine to the drive train to at least partially compensate for the hydraulic system load.

15 Claims, 4 Drawing Sheets

WORK MACHINE, CONTROL SYSTEM AND METHOD FOR CONTROLLING AN ENGINE IN A WORK MACHINE

FIELD OF THE INVENTION

The present invention relates to work machines, and, more particularly, to controlling an engine in a work machine.

BACKGROUND OF THE INVENTION

Work machines are commonly used in the agricultural, construction, and forestry related industries. For example, motor graders employ large blades that may be used for finish grading of a flat surface, such as for a roadway or a parking lot, that may have been rough graded by a bulldozer or scraper. Typical graders have a rear drive train with two axles, and may also have a hydraulic front wheel drive system, with the blade being located between the front wheels and the operator cab, and with the rear drive train axles being located under or aft of the operator cab. An internal combustion engine, such as a diesel engine, typically provides power for both the drive train and for hydraulic system loads, such as the hydraulic front wheel drive and a hydraulic cooling fan. During normal operations of the work machine, the hydraulic loads may vary significantly in a manner not readily predicted, for example, changing as a function of how the work machine is being used and the environment it is operating in. The variation in hydraulic load may adversely affect the power delivered from the engine to the rear drive train, particularly when operating the work machine near the maximum limits established for the engine, and hence adversely affect the operability of the machine.

Notwithstanding advances in the art, there is a still a need for a system and method for controlling an engine in a work machine that may compensate for varying hydraulic loads.

SUMMARY OF THE INVENTION

The present invention provides a work machine, a control system and a method for controlling an engine in a work machine.

The invention, in one form thereof, is directed to a method for controlling an engine in a work machine. The work machine includes a drive train and a hydraulic system. The drive train and the hydraulic system are powered by the engine. The method includes determining a base engine operating limit; determining a hydraulic system load on the engine; calculating a modification value for the base engine operating limit; generating a modified engine operating limit based on the modification value and the base engine operating limit; generating an engine control signal based on the modified engine operating limit; and transmitting the engine control signal to operate the engine at the modified engine operating limit to thereby supply additional power from the engine to the drive train to at least partially compensate for the hydraulic system load.

The invention, in another form thereof, is directed to a work machine. The work machine includes an engine, a drive train coupled to the engine, and a hydraulic system. The hydraulic system includes a hydraulic pump coupled to the engine, and a control system. The control system includes a processing unit and a memory coupled to the processing unit. The memory stores program instructions for controlling at least one of the work machine and the engine. The processing unit is configured to execute the program instructions to determine a base engine operating limit; determine a hydraulic system load on the engine; calculate a modification value for the base engine operating limit; generate a modified engine operating limit based on the modification value and the base engine operating limit; generate an engine control signal based on the modified engine operating limit; and transmit the engine control signal to operate the engine at the modified engine operating limit to thereby supply additional power from the engine to the drive train to at least partially compensate for the hydraulic system load.

The invention, in still another form thereof, is directed to a control system for controlling an engine of a work machine. The work machine includes both a drive train and a hydraulic system. The drive train and the hydraulic system are powered by the engine. The control system includes a processing unit, and a memory coupled to the processing unit. The memory stores program instructions for controlling at least one of the work machine and the engine. The processing unit is configured to execute the program instructions to determine a base engine operating limit; determine a hydraulic system load on the engine; calculate a modification value for the base engine operating limit; generate an engine control signal based on the modified engine operating limit; and transmit the engine control signal to operate the engine at the modified engine operating limit to thereby supply additional power from the engine to the drive train to at least partially compensate for the hydraulic system load.

DETAILED DESCRIPTION OF THE INVENTION

Figure 1:
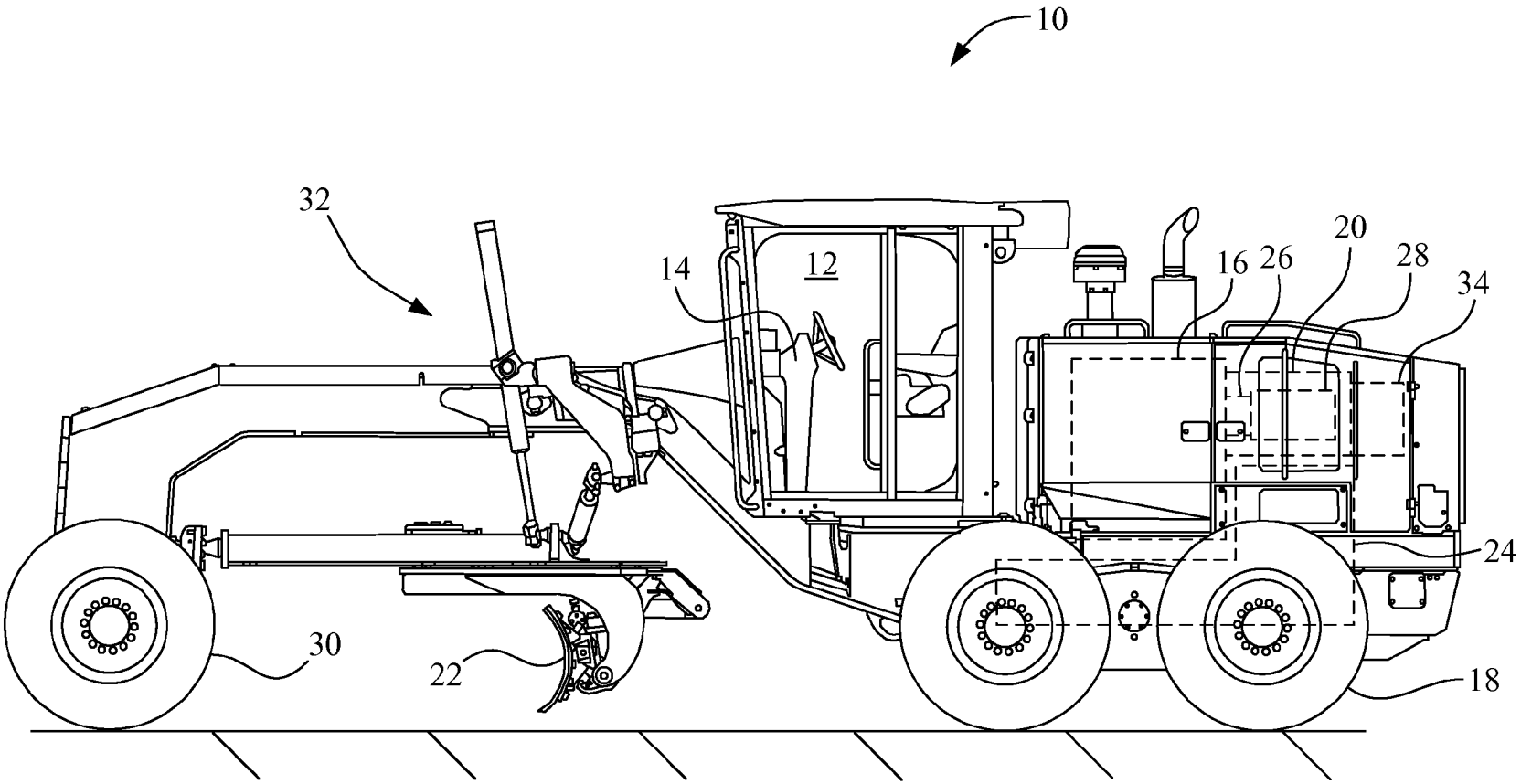
FIG. 1 depicts a grader as an exemplary work machine in accordance with an embodiment of the present invention.

Referring now to FIG. 1, there is shown a work machine 10 in accordance with an embodiment of the present invention. In the present embodiment, work machine 10 is a motor grader. In other embodiments, it is contemplated that work machine 10 may be any type of work machine, such as work machines employed for agricultural, construction, and/or forestry work. Although depicted as being wheel driven, in other embodiments, work machine 10 may be wheel driven and/or track driven.

Work machine 10 may include a cab 12, an operator console 14, an engine 16, a rear drive train 18 culminating in four rear drive wheels, a hydraulic system 20, and a finishing blade 22.

Cab 12 houses the operator of work machine 10 and provides protection from the elements. Operator console 14 may receive input from the operator of work machine 10 for controlling the operations of work machine 10. For example, operator console 14 may include a throttle (not shown) for setting the speed of engine 16, and may include one or more levers (not shown) for controlling the blade height and angle of finishing blade 22. Operator console 14 may also control input devices (not shown) for controlling other features of work machine 10 not mentioned herein.

Engine 16 may be an internal combustion engine, such as a diesel engine. Engine 16 provides motive power to move work machine 10 about during normal operations, e.g., in performing finish grading. Engine 16 also provides power to hydraulic system 20.

Rear drive train 18 includes a transmission 24. Rear drive train 18 is coupled to engine 16 via transmission 24, and delivers power to the wheels and axles (not shown). Transmission 24 includes multiple gears, e.g., first gear, second gear, etc., that may be selected by the operator manually via operator console 14, or which may be automatically selected based on loading conditions of work machine 10.

Hydraulic system 20 includes a hydraulic pump system 26, a valve system 28, a hydraulic front wheel drive 30, a hydraulically actuated grading blade system 32, and a hydraulic cooling fan 34. Hydraulic pump system 26 is coupled to engine 16, and may be driven by engine 16 by a gear train (not shown) having a pump/engine speed ratio that defines hydraulic pump speed relative to engine 16 speed. In the present embodiment, hydraulic pump system 26 may include multiple hydraulic pumps driven by the same gear train, e.g., including a constant displacement pump that provides hydraulic power to operate hydraulic cooling fan 34. In other embodiments, it is alternatively considered that hydraulic pump system 26 may include one or more variable displacement pumps, such as swash-plate pumps, in addition to or in place of one or more constant displacement pumps. Hydraulic pump system 26 is hydraulically coupled to valve system 28, and provides pressurized hydraulic flow to valve system 28.

Valve system 28 may include electrically controlled valves (not shown) that may be selectively operated in response to operator commands via operator console 14 for operating the hydraulic features of work machine 10. In other embodiments, mechanically controlled valves may be used in place of or in addition to electrically controlled valves. Valve system 28 is configured to selectively deliver pressurized hydraulic flow from hydraulic pump system 26 to hydraulic front wheel drive 30, grading blade system 32 and hydraulic cooling fan 34. Valve system 28 may also provide pressurized hydraulic flow to other hydraulically actuated systems of work machine 10 not discussed herein.

Figure 2:
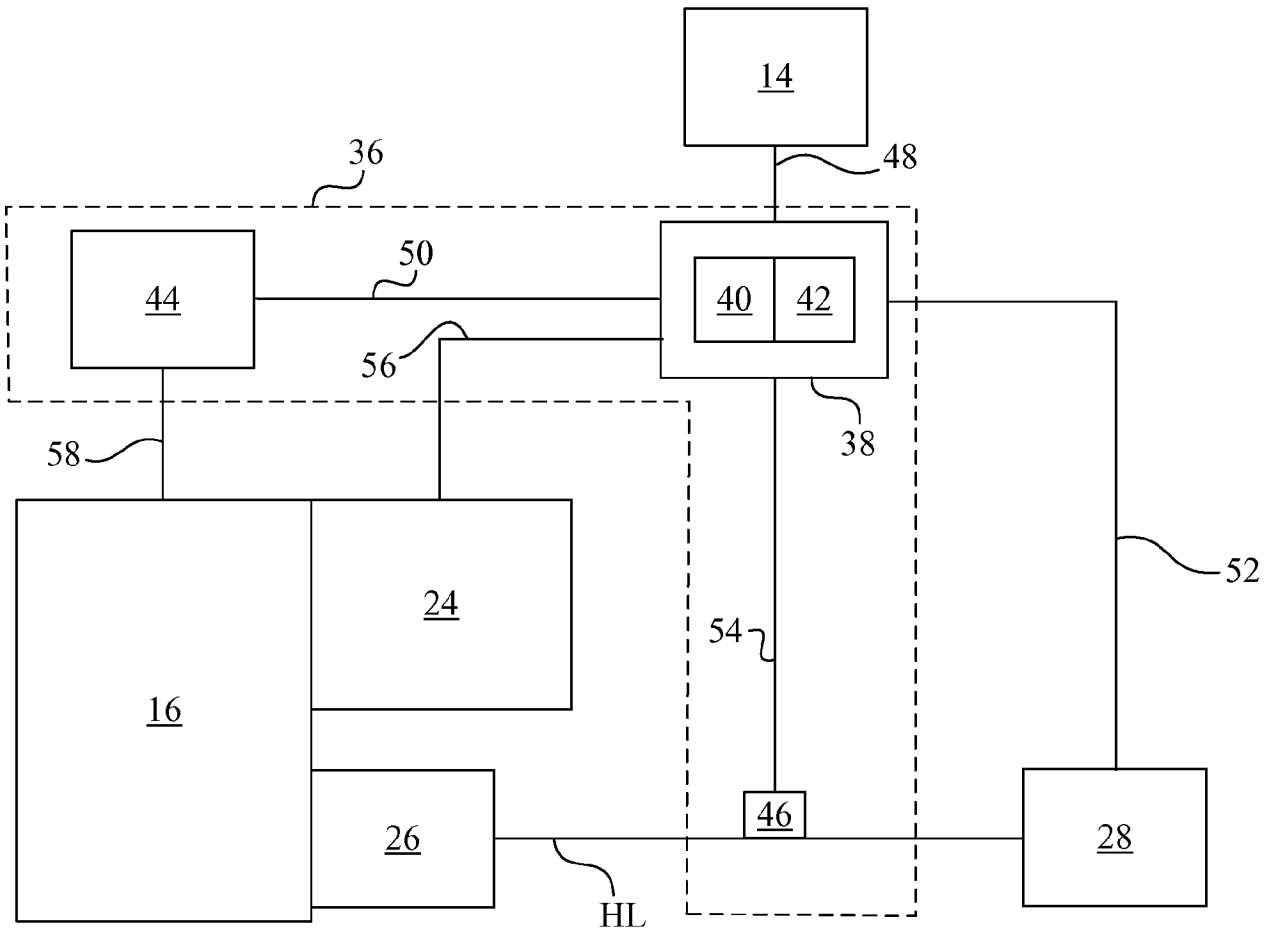
FIG. 2 is a schematic diagram depicting a control system for the work machine of FIG. 1 in accordance with the embodiment of FIG. 1, along with components of the work machine controlled by the control system.

Referring now to FIG. 2, work machine 10 includes a control system 36. Control system 36 is configured to control work machine 10 and engine 16. Control system 36 includes a vehicle controller 38 having a processing unit 40 and memory 42 communicatively coupled thereto, an engine controller 44 and a hydraulic pressure sensor 46. Memory 42 may store program instructions executable by processing unit 40 for controlling work machine 10 and engine 16. In addition, memory 42 may store other information, such as machine model information pertaining to work machine 10, hydraulic pump system 26 displacement data and the pump/engine speed ratio. The hydraulic pump displacement data may include a value for each constant displacement pump in hydraulic pump system 26, or, in cases where hydraulic pump system 26 includes a variable displacement pump, the displacement data may include, for example, lookup tables of displacement values based on a sensed swash plate angle or based on a pump command issued by vehicle controller 38 in response to hydraulic demand. In any event, the displacement data stored in memory 42 may define the displacement of each pump in hydraulic pump system 26. Vehicle controller 38 is communicatively coupled to operator console 14, engine controller 44, valve system 28, hydraulic pressure sensor 46 and transmission 24 via communications links 48, 50, 52, 54 and 56, respectively. Engine controller 44 is communicatively coupled to engine 16 via communications link 58. In the present embodiment, communications links 48, 50, 52, 54, 56 and 58 are digital wired communication links. In particular, communications link 50 is a control area network (CAN) link. However, it will be understood that any convenient form of communications links may be employed, such as wireless communication links or analog communication links, and that each of communications links 48, 50, 52, 54, 56 and 58 may be different kinds of communications links, without departing from the scope of the present invention.

In any case, vehicle controller 38 is configured to control work machine 10 in response to inputs received from operator console 14. In particular, processing unit 40 executes program instructions stored in memory 42 to generate control signals based on the inputs received from operator console 14. In addition, vehicle controller 38 may provide engine control signals to engine controller 44 to direct the operation of engine 16. Engine controller 44 may receive the engine control signals from vehicle controller 38, and control engine 16 in response thereto, for example, by altering fuel injection timing and the amount of fuel injected for combustion in engine 16.

Vehicle controller 38 also provides transmission control signals to transmission 24 to select gears in response to operator input received from operator console 14. In addition, vehicle controller 38 provides control signals to valve system 28 to direct pressurized hydraulic flow from hydraulic pump system 26 to the desired components of hydraulic system 20 in response to operator command signals received from operator console 14.

Hydraulic pressure sensor 46 is configured to sense the hydraulic pressure provided by hydraulic pump system 26, and may be located so as to sense the pressure in a hydraulic line HL that delivers pressurized hydraulic flow from hydraulic pump system 26 to valve system 28 for the operation of hydraulic cooling fan 34. Hydraulic pressure sensor 46 is configured to provide a pressure signal to vehicle controller 38 via communications link 54 that corresponds to the sensed pressure. In other embodiments, hydraulic pressure sensor may be positioned in other locations to sense the hydraulic pressure provided by hydraulic pump system 26. For example, in other embodiments, hydraulic pressure sensor 46 may be mounted on hydraulic pump system 26 or mounted on valve system 28. Also, in other embodiments, additional hydraulic pressure sensors may be employed to measure the hydraulic pressure provided to other hydraulic system components, e.g., hydraulic front wheel drive 30 and/or grading blade system 32.

During normal operations of work machine 10, vehicle controller 38 adjusts the output torque of engine 16 based on various work machine 10 operating parameters. For example, it may be desirable to limit engine 16 output torque based on the currently selected transmission gear in order to avoid drive wheel slip at low ground speeds, in which case a base torque curve for engine 16 is determined by vehicle controller 38. On the other hand, it may be desirable to increase engine output torque to compensate for auxiliary loads, e.g., hydraulic systems loads, so as to not detract from the torque available for the primary function of work machine 10, e.g., performing finish grading by providing power to the drive wheels to drive finishing blade 22. The hydraulic system load results in engine 16 torque being absorbed by hydraulic pump system 26 as hydraulic pump system 26 provides pressurized hydraulic flow to hydraulic front wheel drive 30, grading blade system 32 and hydraulic cooling fan 34.

Generally, torque compensation may be determined based on engine speed, machine state, e.g., transmission gear, and data pertaining to hydraulic system loads. However, hydraulic system 20 loads may vary greatly, and over short periods of time, depending on many factors. For example, ground conditions and slope, outdoor temperatures, and engine loading and corresponding cooling requirements may result in varying rates of hydraulic flow to hydraulic front wheel drive 30, grading blade system 32 and hydraulic cooling fan 34. Hence it may not be possible or practical to accurately compensate for such varying torque loads based on preset values or prepopulated lookup tables. Accordingly, in one aspect of the present invention, maximum engine output torque may be adjusted based on a real-time calculation of engine 16 torque consumed by hydraulic system 20.

Figure 3:
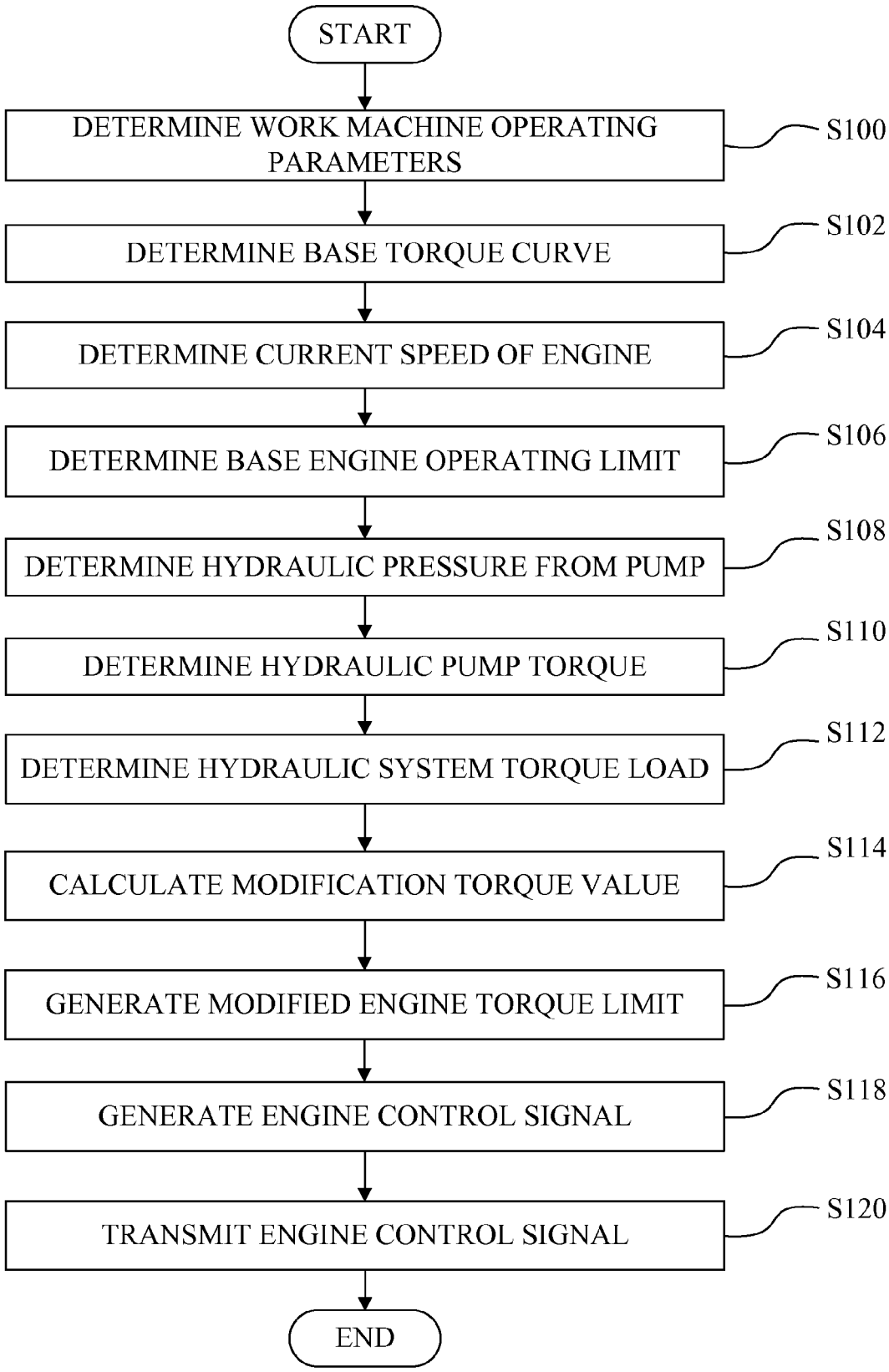
FIG. 3 is a flowchart depicting a method of controlling an engine in a work machine to perform real-time compensation of varying hydraulic system loads.

Referring now to FIG. 3, a method of controlling engine 16 to compensate for hydraulic system loads in accordance with an embodiment of the present invention is depicted with respect to steps S100-S120. Steps S100-S120 are performed on the fly by vehicle controller 38, that is, in real-time during the normal course of operations of work machine 10. In particular, steps S100-S120 are performed based on processing unit 40 executing the program instructions and other data, e.g., stored in memory 42, as well as data received from other components of work machine 10. In the present embodiment, processing unit 40 is a microprocessor, and the program instructions stored in memory 42 are in the form of software. However, it will be understood that processing unit 40 and the program instructions it executes may take other forms without departing from the scope of the present invention. For example, state machines, firmware and/or other hardware implementations may be employed. Although the present embodiment is described using a particular processing sequence, it will be understood that the sequence described herein is exemplary only, and that other suitable sequences may be employed without departing from the scope of the present invention.

In the present embodiment, the method of steps S100-S120 is performed in order to compensate for the hydraulic loads on engine 16 resulting from the operation of hydraulic cooling fan 34. However, it will be understood that the methodology described herein may also be applied in order to compensate for hydraulic loads on engine 16 resulting from the operation of other hydraulic system components in place of or in addition to hydraulic cooling fan 34, without departing from the scope of the present invention. For example, compensation for the hydraulic loads imposed on engine 16 via the operation of hydraulic front wheel drive 30 and/or grading blade system 32 may similarly be performed using steps S100-S120. In any case, the torque compensation may employ determinations based on the pressure delivered by the particular hydraulic pumps of hydraulic pump system 26 that supply pressurized hydraulic flow to such hydraulic system components for which compensation is desired. Nonetheless, the compensation described herein is for torque loads on engine 16 resulting from the operation of hydraulic cooling fan 34, and in the present embodiment, is based on the displacement of the particular pump that supplies pressurized hydraulic flow to operate hydraulic cooling fan 34, and based on the pressure supplied by that pump as measured by hydraulic pressure sensor 46.

At step S100, vehicle controller 38 determines work machine 10 operating parameters. For example, vehicle controller 38 reads machine model information for work machine 10 from memory 42. In addition, vehicle controller 38 determines the currently engaged transmission gear and the status, on or off, of hydraulic front wheel drive 30.

At step S102, vehicle controller 38 determines a base torque curve, based on based on the operating parameters determined at step S100. The base torque curve establishes the maximum torque output of engine 16 at any given engine 16 speed in the absence of compensation for hydraulic system loads. In the present embodiment, the base torque curve is designed to limit the torque provided to rear drive train 18 due to design torque limitations of rear drive train 18. The torque limitations of rear drive train 18 may vary depending upon the transmission gear that is engaged. The base torque curve may also be designed to limit the torque supplied by engine 16 to rear drive train 18 in order to prevent wheel slippage, e.g., at low ground speeds. The base torque curve is also designed to fall below an emissions-related torque limit that defines the maximum torque that may be produced by engine 16 at any given speed without generating exhaust emissions that exceed government-designated limits, e.g., as established by the U.S. Government's Environmental Protection Agency (EPA). Although a base torque curve is employed in the present embodiment, it will be understood that other engine 16 output parameters may be employed, e.g., a base power curve instead of a base torque curve.

Figure 4:
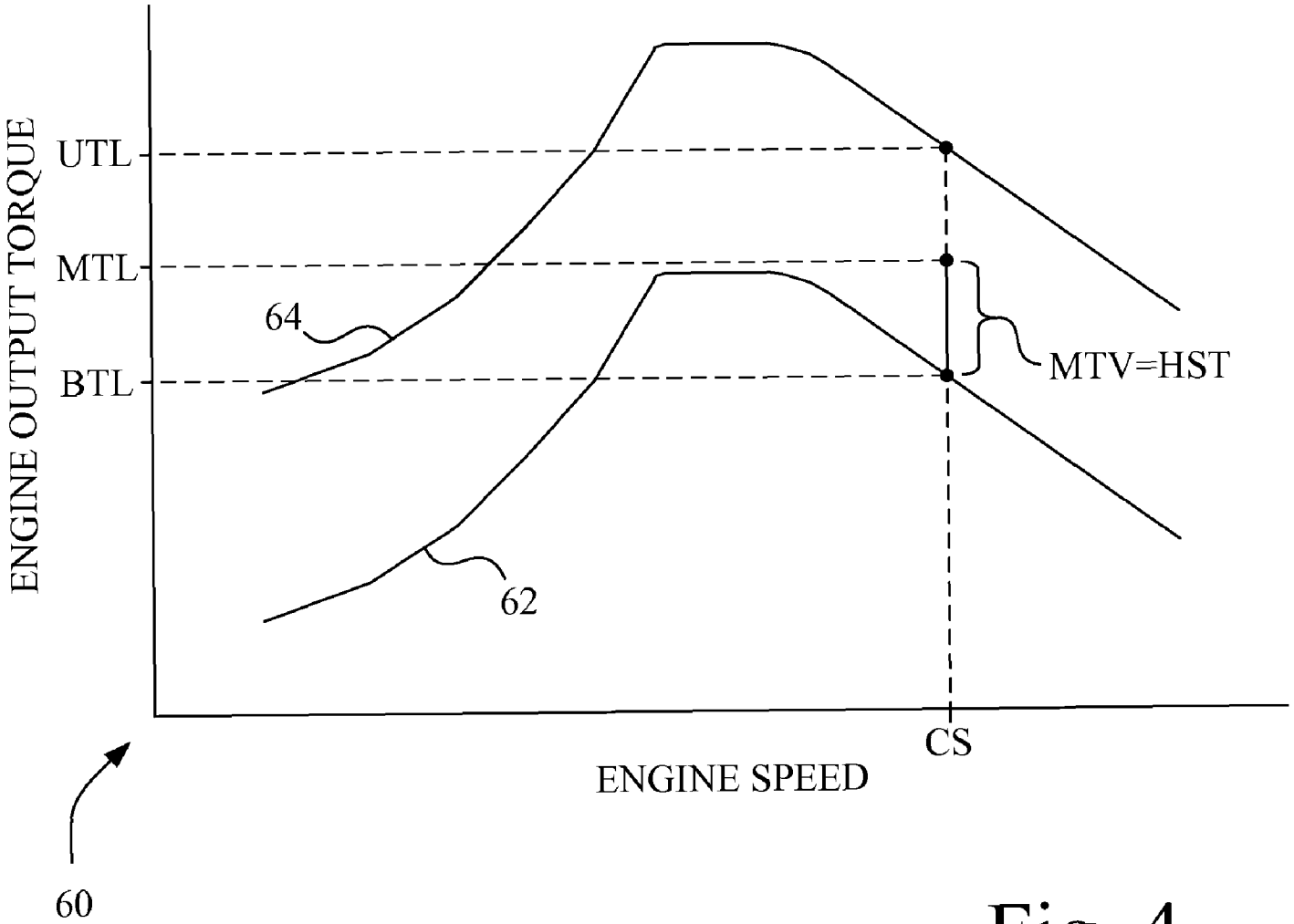
FIG. 4 graphically illustrates a plot depicting engine torque curves and a modification to a base engine operating limit in accordance with the embodiment of FIG. 3.

Referring now to FIG. 4, a plot 60 representing engine 16 torque vs. speed is graphically depicted. The ordinate of plot 60 is engine torque, and the abscissa is engine speed. The base torque curve established at step S102 is depicted in the form of a base torque curve 62, which falls below the emissions-related torque limit depicted as an emissions-related torque curve 64.

Referring again to FIG. 3, in conjunction with FIG. 4, at step S104, vehicle controller 38 determines a current speed of engine 16, e.g., by reading engine speed data from engine controller 44 via communications link 50. The current speed of engine 16 is depicted as point CS along the abscissa of plot 60 in FIG. 4.

At step S106, vehicle controller 38 determines a base engine operating limit for engine 16 based on the current speed CS of engine 16. The base engine operating limit pertains to the maximum allowed output of engine 16 at the current speed CS in the absence of the torque compensation, and varies with the speed of engine 16. In the present embodiment, the base engine operating limit is in the form of a base engine torque limit, which is the engine 16 torque given by base torque curve 62 at the current speed CS of engine 16. However, it will be understood that the base engine operating limit may be in the form of other engine 16 output parameters instead of torque, such as power, without departing from the scope of the present invention. The base engine torque limit at engine speed CS is depicted as point BTL along the ordinate of plot 60 in FIG. 4. Thus, at engine speed CS, the maximum torque output of engine 16 permitted by vehicle controller 38 in the absence of torque compensation for hydraulic system 20 loads is given by base engine torque limit BTL.

At step S108, vehicle controller 38 determines the hydraulic pressure supplied from hydraulic pump system 26 to hydraulic cooling fan 34 based on the pressure signal received from hydraulic pressure sensor 46.

At step S110, vehicle controller 38 determines the torque at hydraulic pump system 26 associated with hydraulic cooling fan 34 operation, based on the displacement data and the hydraulic pressure determined at step S108, for example, by multiplying the displacement and pressure, and dividing the product by a unit conversion constant.

At step S112, vehicle controller 38 determines the torque at engine 16 that is absorbed by hydraulic pump system 26 resulting from the operation of hydraulic cooling fan 34, which is the torque load of hydraulic system 20 on engine 16 for which torque compensation in the present embodiment is sought. The hydraulic system 20 torque load may be determined by multiplying the torque at hydraulic pump system 26 determined at step S110 by the pump/engine speed ratio stored in memory 42.

At step S114, a modification value for the base engine torque limit is calculated. In the present embodiment, the modification value is a modification torque value that may be added to the basic engine torque limit BTL in order to at least partially compensate for, e.g., offset, the hydraulic system 20 torque load on engine 16, e.g., the torque load resulting from the operation of hydraulic cooling fan 34. For example, with reference to FIG. 4, an upper torque limit UTL at current speed CS is defined by emissions-related torque curve 64. If the hydraulic system 20 torque load is less than the difference between upper torque limit UTL and basic engine torque limit BTL, the modification value may correspond to the hydraulic system 20 torque load, which may be added to basic engine torque limit BTL in order to yield a modified engine operating limit in the form of a modified engine torque limit that fully compensates for the hydraulic system 20 torque load on engine 16. On the other hand, if the hydraulic system 20 torque load is greater than the difference between upper torque limit UTL and basic engine torque limit BTL, the modification value may correspond to only a portion the hydraulic system 20 torque load, which may be added to basic engine torque limit BTL in order to yield a modified engine operating limit in the form of a modified engine torque limit that is bounded by the upper torque limit UTL at current speed CS.

At step S116, the modified engine operating limit is generated by vehicle controller 38 based on the modification value and the base engine operating limit, e.g., by adding the modification torque value to the base engine torque limit to yield a modified engine torque limit. For example, with reference to FIG. 4, an example is depicted wherein a hydraulic system 20 torque load HST is less than the difference between the upper torque limit UTL and basic engine torque limit BTL. Hence a modification torque value MTV that equals hydraulic system 20 torque load HST may be added to basic engine torque limit BTL to yield a modified engine operating limit in the form of a modified engine torque limit MTL. In such a case, the modified engine torque limit MTL is thus configured to fully offset the hydraulic system 20 torque load, and thereby provide torque from engine 16 to rear drive train 18 at base engine torque limit BTL.

However, in cases where the hydraulic system 20 torque load equals or exceeds the upper torque limit UTL, the modified engine torque limit may only be equal to or less than upper torque limit UTL. In such a case, the modified engine torque limit MTL is thus configured to only partially offset hydraulic system 20 torque load, wherein the maximum value of the modified engine torque limit is the emissions-related torque limit depicted as upper torque limit UTL at current engine 16 speed CS.

At step S118, an engine control signal is generated by vehicle controller 38 based on the modified engine torque limit, e.g., modified engine torque limit MTL.

At step S120, vehicle controller 38 transmits the engine control signal generated at step S118 to engine controller 44 via communications link 50 to operate engine 16 at the modified engine operating limit, e.g., given by modified engine torque limit MTL. By dong so engine 16 may supply additional power to rear drive train 18 to at least partially compensate for the hydraulic system 20 load, depending on the magnitude of the hydraulic system 20 load, e.g., as set forth above.

The process of steps S100-S120 may be continually repeated during normal operations of work machine 10 in order to provide continuous real-time compensation for the varying hydraulic system 20 loads. This may allow engine 16 to transmit a consistent amount of torque through rear drive train 18, notwithstanding the variation in hydraulic system 20 load, which may result in a more consistent performance of work machine 10 than if the torque compensation were not performed. In addition, since the modified engine torque limit is based on actual hydraulic system 20 loads, rather than simply increasing the base engine torque limit to compensate for assumed hydraulic system 20 loads, the torque output of engine 16 is limited when hydraulic loads are low, which may prevent excessive torque from being transmitted through rear drive train 18, which may thereby extend the life of rear drive train 18.

Having described the preferred embodiment, it will become apparent that various modifications can be made without departing from the scope of the invention as defined in the accompanying claims.

The invention claimed is:

1. A method for controlling an engine in a work machine, said work machine including a drive train and a hydraulic system, said drive train and said hydraulic system being powered by said engine, comprising:

determining a base engine operating limit;

determining a hydraulic system load on said engine;

calculating a modification value for said base engine operating limit;

generating a modified engine operating limit based on said modification value and said base engine operating limit;

generating an engine control signal based on said modified engine operating limit; and transmitting said engine control signal to operate said engine at said modified engine operating limit to thereby supply additional power from said engine to said drive train to at least partially compensate for said hydraulic system load, said hydraulic system including a hydraulic pump powered by said engine wherein said determining said hydraulic system load step includes:

determining a hydraulic pressure supplied by said hydraulic pump; and calculating said hydraulic system load based on said hydraulic pressure, said hydraulic pump having a displacement associated therewith, a pump/engine speed ratio defines a hydraulic pump speed relative to an engine speed, said calculating said hydraulic system load step calculates a hydraulic system torque load on said engine based on said hydraulic pressure, said displacement of said pump, and said pump/engine speed ratio.

2. The method of claim 1, wherein said modification value is configured to offset said hydraulic system load.

3. The method of claim 1, wherein said base engine operating limit is a base engine torque limit, wherein said hydraulic system load is a hydraulic system torque load on said engine, and wherein said modified engine operating limit is a modified engine torque limit configured to fully offset said hydraulic system torque load and thereby provide torque from said engine to said drive train at said base engine torque limit.

4. The method of claim 1, wherein said hydraulic system load is a hydraulic system torque load on said engine, wherein said modified engine operating limit is a modified engine torque limit configured to at least partially offset said hydraulic system torque load, and wherein a maximum value of said modified engine torque limit is an emissions-related torque limit.

5. The method of claim 1, wherein said base engine operating limit varies with a speed of said engine, further comprising:

determining a current speed of said engine, wherein said base engine operating limit is determined based on said current speed of said engine.

6. A work machine, comprising, an engine;

a drive train coupled to said engine;

a hydraulic system, said hydraulic system including a hydraulic pump coupled to said engine; and a control system, said control system including a processing unit and a memory coupled to said processing unit, said memory storing program instructions for controlling at least one of said work machine and said engine, said processing unit being configured to execute said program instructions to:

determine a base engine operating limit;

determine a hydraulic system load on said engine;

calculate a modification value for said base engine operating limit;

generate a modified engine operating limit based on said modification value and said base engine operating limit;

generate an engine control signal based on said modified engine operating limit; and transmit said engine control signal to operate said engine at said modified engine operating limit to thereby supply additional power from said engine to said drive train to at least partially compensate for said hydraulic system load, wherein said determining said hydraulic system load includes said processor unit executing said program instructions to:

determine a hydraulic pressure supplied by said hydraulic pump; and calculate said hydraulic system load based on said hydraulic pressure, said hydraulic pump having a displacement associated therewith, a pump/engine speed ration defines a hydraulic pump speed relative to an engine speed, and said calculating said hydraulic system load is calculating a hydraulic system torque load on said engine based on said hydraulic pressure, said displacement of said pump, and said pump/engine speed ratio.

7. The work machine of claim 6, wherein said modification value is configured to offset said hydraulic system load.

8. The work machine of claim 6, wherein said base engine operating limit is a base engine torque limit, wherein said hydraulic system load is a hydraulic system torque load on said engine, and wherein said modified engine operating limit is a modified engine torque limit configured to fully offset said hydraulic system torque load and thereby provide torque from said engine to said drive train at said base engine torque limit.

9. The work machine of claim 6, wherein said hydraulic system load is a hydraulic system torque load on said engine, wherein said modified engine operating limit is a modified engine torque limit configured to at least partially offset said hydraulic system torque load, and wherein a maximum value of said modified engine torque limit is an emissions-related torque limit.

10. The work machine of claim 6, wherein said base engine operating limit varies with a speed of said engine, further comprising:

determining a current speed of said engine, wherein said base engine operating limit is determined based on said current speed of said engine.

11. A control system for controlling an engine of a work machine, said work machine including both a drive train and a hydraulic system, said drive train and said hydraulic system being powered by said engine, comprising:

a processing unit; and a memory coupled to said processing unit, said memory storing program instructions for controlling at least one of said work machine and said engine; and said processing unit being configured to execute said program instructions to:

determine a base engine operating limit;

determine a hydraulic system load on said engine;

calculate a modification value for said base engine operating limit;

generate an engine control signal based on said modified engine operating limit; and transmit said engine control signal to operate said engine at said modified engine operating limit to thereby supply additional power from said engine to said drive train to at least partially compensate for said hydraulic system load, said hydraulic system including a hydraulic pump powered by said engine, wherein said determining said hydraulic system load instruction includes:

determining a hydraulic pressure supplied by said hydraulic pump; and calculating said hydraulic system load based on said hydraulic pressure, said hydraulic pump has a displacement associated therewith: a pump/engine speed ratio defines a hydraulic pump speed relative to an engine speed, and said calculating said hydraulic system load is calculating a hydraulic system torque load on said engine based on said hydraulic pressure, said displacement of said pump, and said pump/engine speed ratio.

12. The control system of claim 11, wherein said modification value is configured to offset said hydraulic system load.

13. The control system of claim 11, wherein said base engine operating limit is a base engine torque limit, wherein said hydraulic system load is a hydraulic system torque load on said engine, and wherein said modified engine operating limit is a modified engine torque limit configured to fully offset said hydraulic system torque load and thereby provide torque from said engine to said drive train at said base engine torque limit.

14. The control system of claim 11, wherein said hydraulic system load is a hydraulic system torque load on said engine, and wherein said modified engine operating limit is a modified engine torque limit configured to at least partially offset said hydraulic system torque load, and wherein a maximum value of said modified engine torque limit is an emissions-related torque limit.

15. The control system of claim 11, wherein said base engine operating limit varies with a speed of said engine, further comprising:

determining a current speed of said engine, wherein said base engine operating limit is determined based on said current speed of said engine.

* * * * *